US007621167B2

(12) United States Patent
Staffend

(10) Patent No.: US 7,621,167 B2
(45) Date of Patent: Nov. 24, 2009

(54) METHOD OF FORMING A ROTARY DEVICE

(76) Inventor: Gilbert Staffend, 24093 Tana Ct., Farmington, MI (US) 48335-3401

( * ) Notice: Subject to any disclaimer, the term of this patent is extended or adjusted under 35 U.S.C. 154(b) by 447 days.

(21) Appl. No.: 11/532,376

(22) Filed: Sep. 15, 2006

(65) Prior Publication Data

US 2008/0245127 A1 Oct. 9, 2008

Related U.S. Application Data

(63) Continuation-in-part of application No. 11/133,824, filed on May 20, 2005, now Pat. No. 7,556,015.

(60) Provisional application No. 60/718,029, filed on Sep. 16, 2005, provisional application No. 60/572,706, filed on May 20, 2004.

(51) Int. Cl.
*B21C 37/06* (2006.01)
*B21D 13/00* (2006.01)
*B21B 15/00* (2006.01)

(52) U.S. Cl. ..... 72/368; 72/379.6; 72/168

(58) Field of Classification Search ..... 72/168, 72/177, 367.1, 368, 379.6, 370.19, 385; 29/428, 29/525.14; 219/121.64, 121.14; 228/173.1–173.7
See application file for complete search history.

(56) References Cited

U.S. PATENT DOCUMENTS 1,684,254 A 9/1928 Bailey
1,859,618 A 5/1932 Cleland
2,420,401 A 5/1947 Prokofieff
3,118,432 A 1/1964 Peterson
3,151,806 A 10/1964 Whitfield
3,171,391 A 3/1965 Appleton
3,276,386 A 10/1966 Fanshawe
3,280,804 A 10/1966 Hellbaum
3,467,070 A 9/1969 Green
3,548,790 A 12/1970 Pitts
3,568,645 A 3/1971 Gtimm
3,572,030 A 3/1971 Cuff
3,727,589 A 4/1973 Scott
3,745,979 A 7/1973 Williams
3,780,708 A 12/1973 Angsten
3,797,464 A 3/1974 Abbey
3,829,944 A 8/1974 Wilmers
3,865,085 A 2/1975 Stenbert
3,931,810 A 1/1976 McGathey
3,934,321 A 1/1976 Iida et al.
3,964,450 A 6/1976 Lockshaw (Continued)

*Primary Examiner*—Dana Ross
*Assistant Examiner*—Teresa M Bonk
(74) *Attorney, Agent, or Firm*—Jon E. Shackelford; Dickinson Wright PLLC

(57) ABSTRACT

The present invention is a method of constructing a rotary device which as an outer hub and an inner hub disposed within the outer hub. One of the inner and outer hubs is rotatable with respect to the other one of the inner and outer hubs about an axis. A ribbon of material extends between opposite ends and is roll formed to achieve a desired profile of an inner and outer peripheral wall of the inner and outer hub, respectively. The roll formed ribbons of material are each secured to maintain the desired profile and achieve the respective peripheral wall. The inner peripheral wall is inserted inside the outer peripheral wall such that the outer peripheral wall surrounds the inner peripheral wall.

19 Claims, 8 Drawing Sheets

U.S. PATENT DOCUMENTS 3,973,525 A 8/1976 Keylwert
4,157,011 A 6/1979 Liddle
4,169,451 A 10/1979 Niggemeyer
4,170,441 A * 10/1979 Trzeciak ..... 418/48
4,241,713 A 12/1980 Crutchfield
4,362,480 A 12/1982 Suzuki et al.
4,552,107 A 11/1985 Chen
4,599,059 A 7/1986 Hsu
4,770,084 A 9/1988 Miwa et al.
4,969,378 A 11/1990 Lu et al.
5,056,314 A 10/1991 Paul et al.
5,184,526 A 2/1993 Watanabe
5,433,179 A 7/1995 Wittry
5,494,014 A 2/1996 Lobb
5,524,587 A 6/1996 Mallen et al.
5,531,197 A 7/1996 Lobb
5,595,154 A 1/1997 Smith
5,622,149 A 4/1997 Wittry
5,640,938 A 6/1997 Craze
5,895,210 A 4/1999 Nakaniwa et al.
6,015,279 A 1/2000 Yamane
6,125,814 A 10/2000 Tang
6,149,718 A * 11/2000 Cowan et al. ..... 96/147
6,178,633 B1 1/2001 Yamane
6,179,596 B1 1/2001 Weisener et al.
6,227,833 B1 5/2001 Froslev et al.
6,264,451 B1 7/2001 Murayama et al.
6,543,132 B1 4/2003 Krueger
6,551,083 B2 4/2003 Weisener et al.
6,588,395 B2 7/2003 DeFazio
6,609,371 B2 8/2003 Scuderi
6,643,927 B2 11/2003 Murayama et al.
6,722,127 B2 4/2004 Scuderi et al.
6,880,502 B2 4/2005 Scuderi
6,932,588 B2 8/2005 Choi et al.
6,986,329 B2 1/2006 Scuderi et al.
7,017,536 B2 3/2006 Scuderi
2004/0041005 A1* 3/2004 Tanaka et al. ..... 228/112.1
2005/0042077 A1 2/2005 Gekht et al.

* cited by examiner

FIG - 1
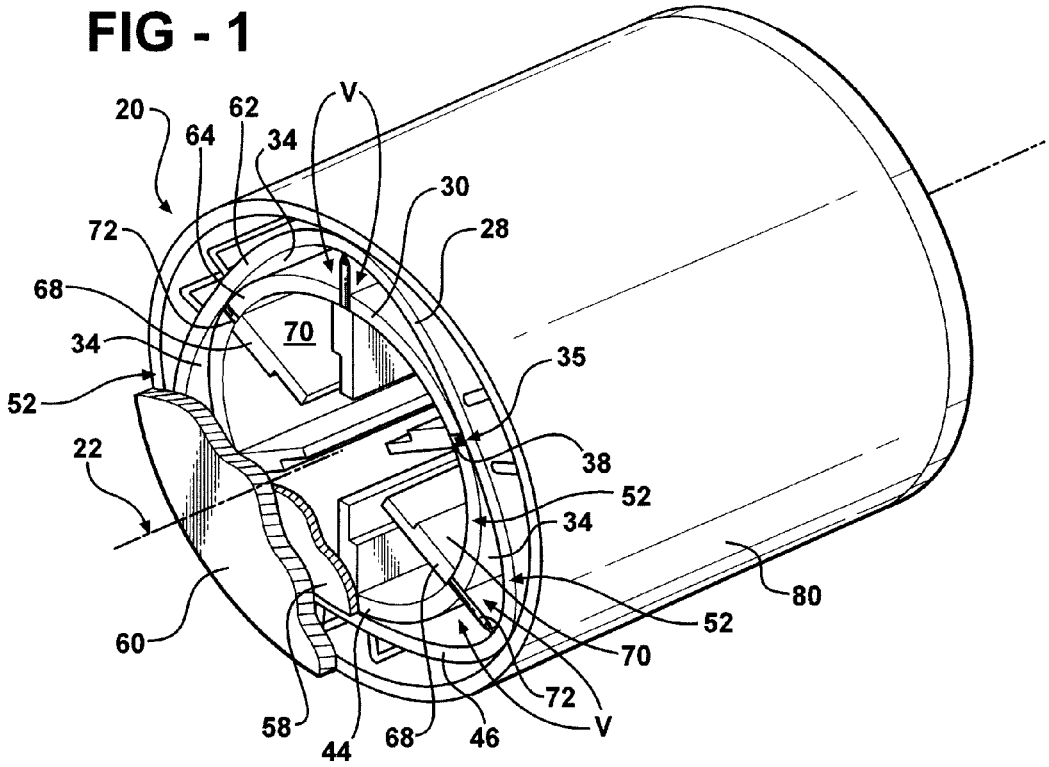
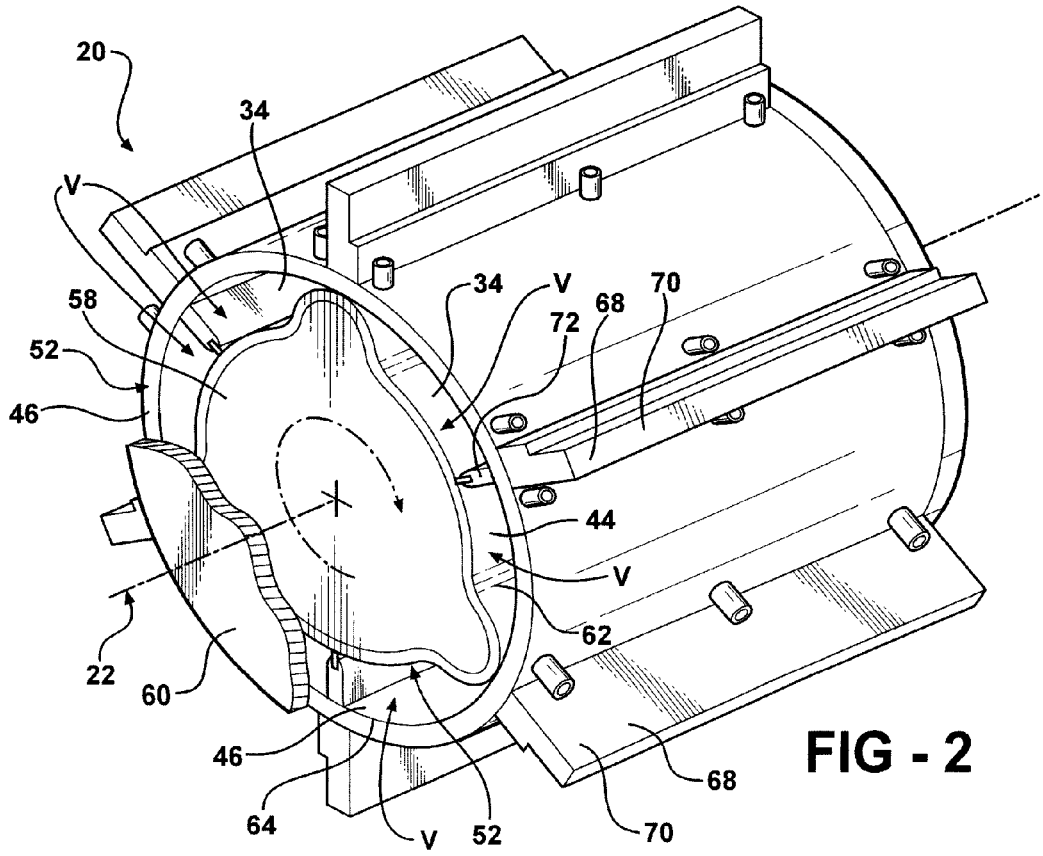
FIG - 2

FIG - 5
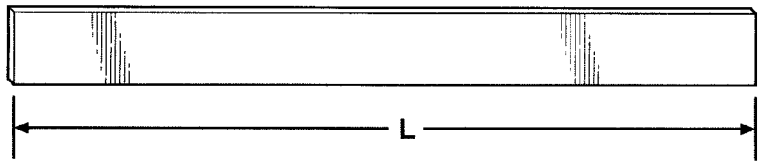
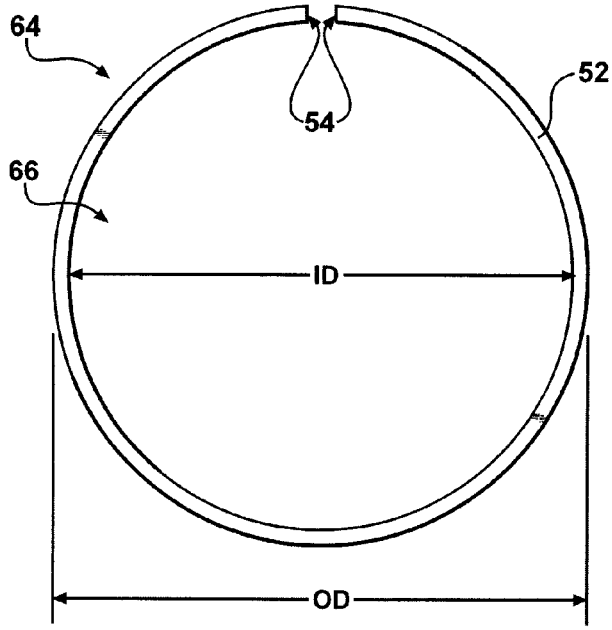
FIG - 6A
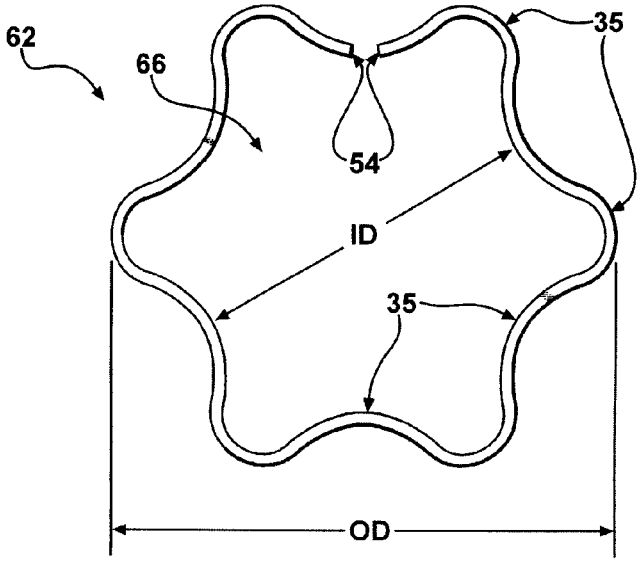
FIG - 7A

FIG - 11A
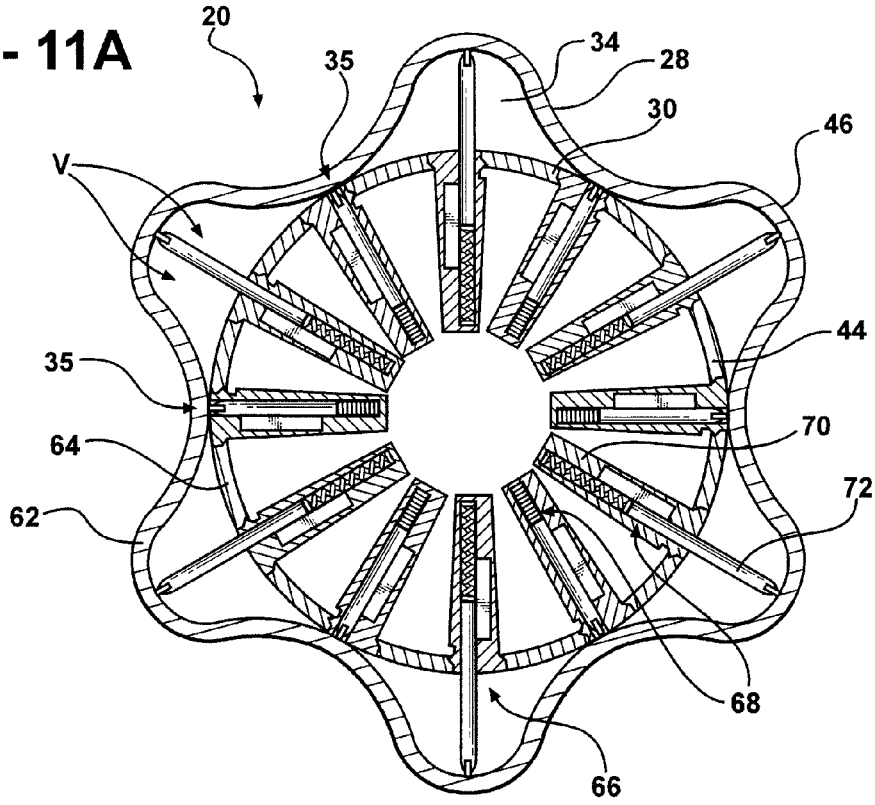
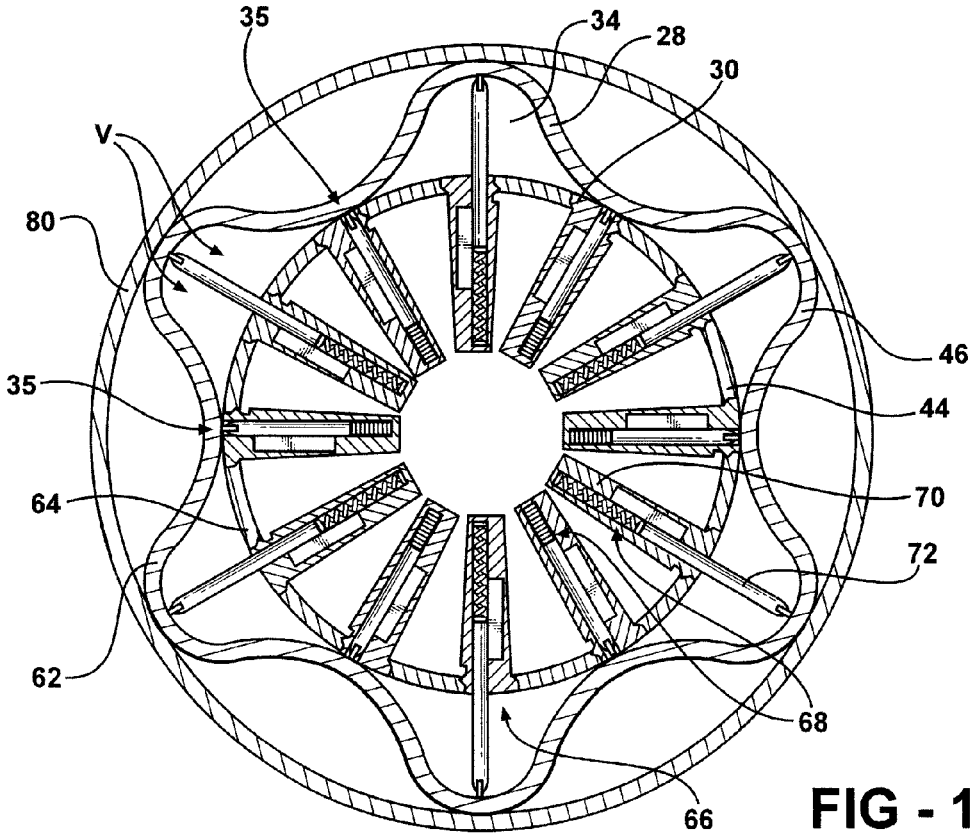
FIG - 11B

METHOD OF FORMING A ROTARY DEVICE

CROSS REFERENCE TO RELATED APPLICATION

This application claims the benefit U.S. Provisional Patent Application Ser. No. 60/718,029 filed Sep. 16, 2005 and is a continuation-in-part of U.S. patent application Ser. No. 11/133,824 filed on May 20, 2005, which claimed priority to U.S. Provisional Patent Application Ser. No. 60/572,706 filed May 20, 2004, and is related to U.S. Ser. No. 11/532,385, filed on the same date as this application and entitled "Transmission Between Rotary Devices", and is related to U.S. Ser. No. 11/532,366, filed on the same date as this application and entitled "Method of Decoupling Using a Rotary Device," which are hereby incorporated by reference.

BACKGROUND OF THE INVENTION

1. Field of the Invention

The invention generally relates to a method of forming a rotary device.

2. Description of the Related Art

Traditional rotary devices include a stator and rotor which is rotatable with respect to the stator about an axis. These rotary devices are typically formed from castings. An example of a rotary device which is formed from castings is disclosed in U.S. Pat. No. 3,780,708 to Angsten (the '708 patent). The rotary device includes a stator defining a center bore and a stator which rotates within the center bore of the stator. The '708 patent shows the stator and the rotor formed from a thick cast material. End plates are bolted into place to seal the rotor within the stator.

Additionally, with casting these components, the center bore must be honed to achieve circularity within the hole. However, this circularity can vary greatly between castings. As known to those skilled in the art of manufacturing engines, casting of engine blocks for internal combustion engines also requires machining to hone cylinder bores into the castings. Piston matching must be employed during the manufacture of the internal combustion engine. This is because the circularity of the bores and the pistons are not repeatable and vary widely. Therefore, pistons must be matched, by trial and error, to determine which ones match the bores.

The use of cast components adds a significant amount of weight to the rotary device. Additionally, because the circularity of machining the cast components varies greatly between castings, it can become very time consuming, wasteful, and expensive to employ matching between the rotor and the stator.

SUMMARY OF THE INVENTION AND ADVANTAGES

The present invention is a method of constructing a rotary device having an outer hub and an inner hub disposed within the outer hub where one of the inner and outer hub is rotatable with respect to the other one of the inner and outer hub about an axis. A first ribbon of material extends between opposite ends and is roll formed to achieve a desired profile of an outer peripheral wall. The roll formed first ribbon of material is secured to maintain the desired profile and achieve the outer peripheral wall. A second ribbon of material extends between opposite ends and is roll formed to achieve a desired profile of an inner peripheral wall. The roll formed second ribbon of material is secured to maintain the desired profile and achieve the inner peripheral wall. The inner peripheral wall is inserted inside the outer peripheral wall such that the outer peripheral wall surrounds the inner peripheral wall.

By forming the walls of the rotary device from roll forming, many manufacturing benefits are achieved. By implementing polished surface tolerances, the need for lubrication is reduced or eliminated. Polished surface tolerances are delivered by roll formed metal components which replace traditional metal castings, including any contours of the components. The size, weight, overall system dimensions are reduced. Excess casting weight due to designed-in pouring path and porosity prevention are eliminated. Using precision, in place of extra materials and lubrication, major seal and friction issues typical with traditional rotary devices are eliminated.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is perspective view of a rotary device illustrating an inner hub having a circular peripheral wall and an outer hub having an undulating peripheral wall;

FIG. 2 is a perspective view of an alternative embodiment of the rotary device illustrating the inner hub having the undulating peripheral wall and the outer hub having the circular peripheral wall;

FIG. 5 is a top perspective view of a strip of material for forming one of the peripheral walls;

FIG. 6*a* is an end view of the strip of material of FIG. 5, roll formed to a desired profile;

FIG. 7*a* is an end view of the strip of material of FIG. 5, roll formed to a desired profile;

FIG. 11*a* is a cross sectional end view of the rotary device illustrating the outer hub having the undulating peripheral wall and the inner hub having the circular peripheral wall with the vane assemblies attached to the inner hub;

FIG. 11*b* is a cross sectional end view of the rotary device illustrating the outer hub having the undulating peripheral wall and the inner hub having the circular peripheral wall with the vane assemblies attached to the inner hub and a circular wall surrounding the outside of the undulating peripheral wall;

DETAILED DESCRIPTION OF THE INVENTION

Figure 3:
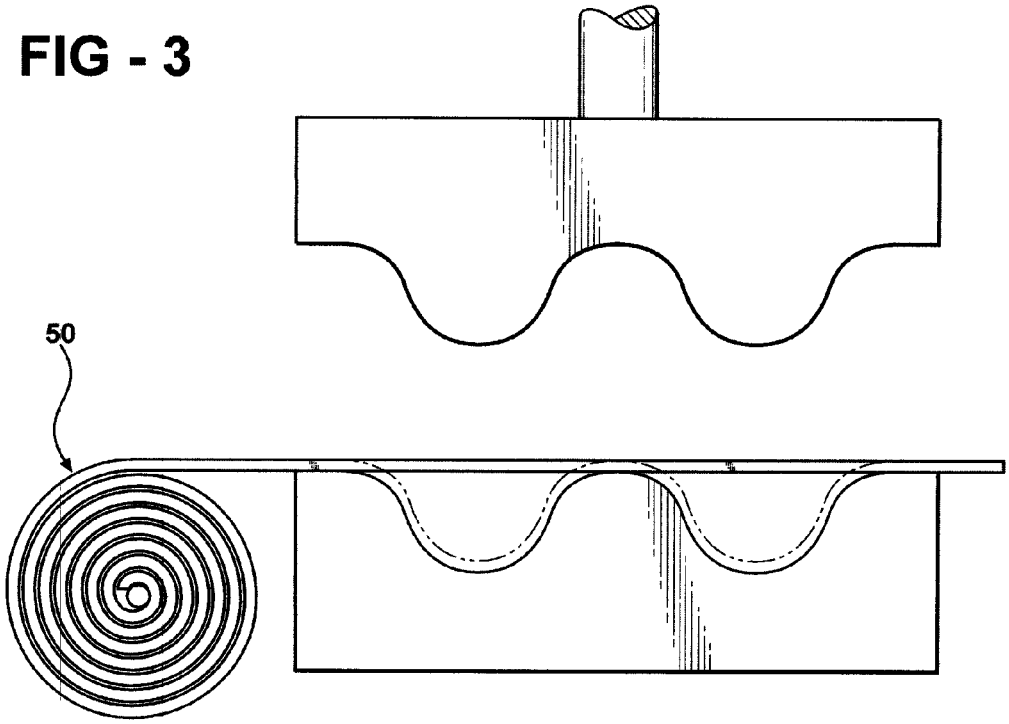
FIG. 3 illustrates a stamping process of material to form a strip of material.

The present invention relates to a rotary device, such as a rotary engine. The rotary device is shown generally at 20 in FIGS. 1 and 2. The rotary device 20 includes an outer hub 28 and an inner hub 30 disposed within the outer hub 28. Each of the hubs 28, 30 are generally centered about an axis 22 such that one of the hubs 28, 30 rotates with respect to the other hub 28, 30 about the axis 22. Each of the hubs 28, 30 represents either a stator or a rotor where the rotor is rotatable with respect to the stator about the axis 22. Therefore, the stator is static, i.e., the stator does not rotate, and the rotor is generally concentric with, and rotatable with respect to, the stator about the axis 22. In one embodiment, the stator surrounds the rotor on the axis 22. In an alternative embodiment, the rotor surrounds the stator about the axis 22. A bearing may be disposed on the axis 22 for facilitating rotation of the rotor with respect to the stator 24. Alternatively, the relative movement between the rotor and the stator may act as the only bearing.

Figure 4:
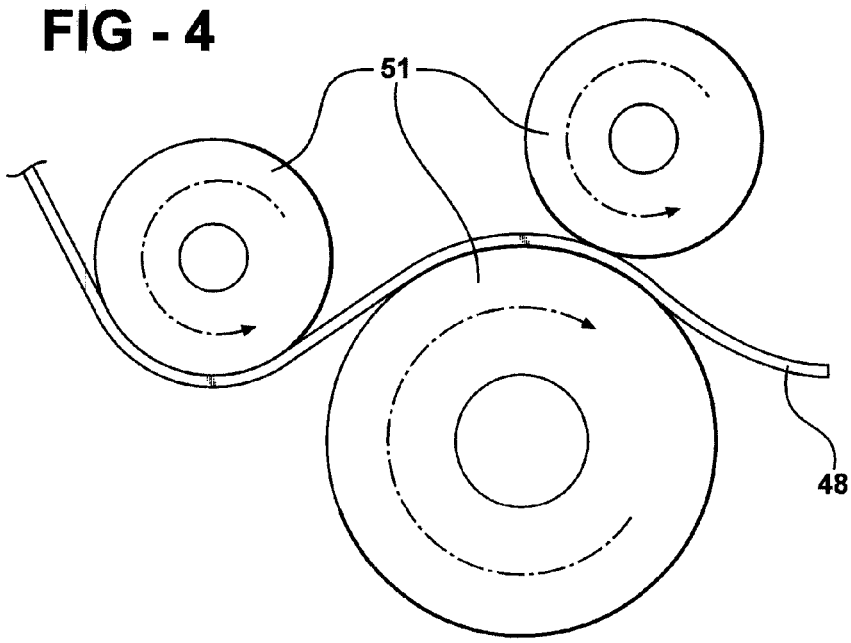
FIG. 4 illustrates a roll forming process of the strip of material.
Figure 6B:
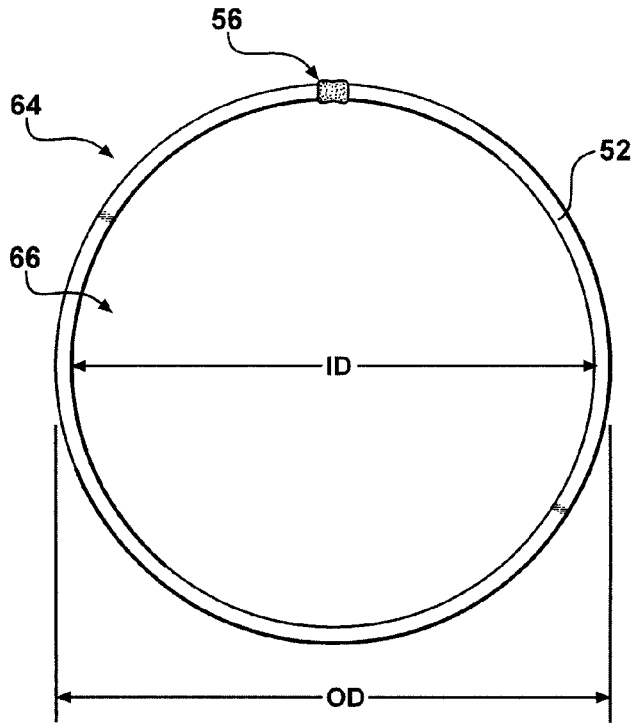
FIG. 6*b* is an end view of the strip of roll formed material of FIG. 6*a* having a seam holding the strip of material in the desired profile.
Figure 7B:
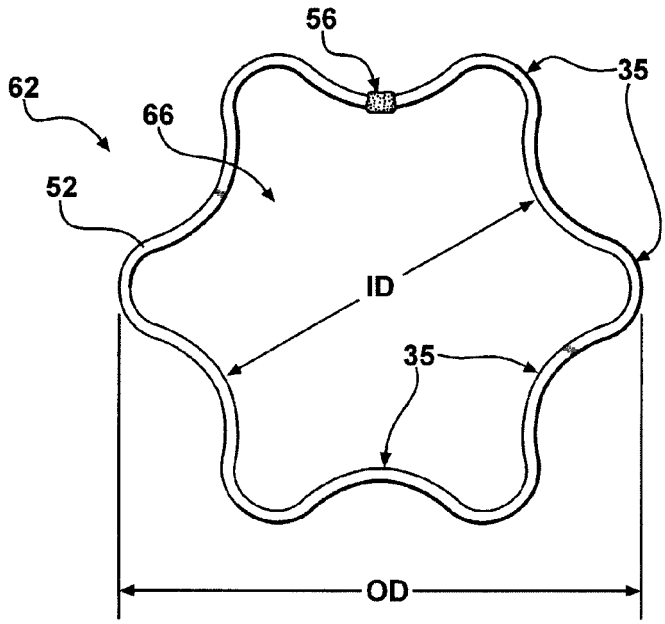
FIG. 7*b* is an end view of the strip of material of FIG. 7*a* having a seam holding the strip of material in the desired profile.

The inner and outer hubs 28, 30 each include a peripheral wall, i.e., an inner and outer peripheral wall 44, 46, respectively. The peripheral walls 44, 46 are formed from a strip of material 48. Typically, the strip of material 48 is formed by stamping, as shown in FIG. 3. The strip of material 48 is preferably steel, but any other suitable material may also be used. Ideally, permanent lubrication is achieved by employing dissimilar metals and sacrificial coatings. Typically, the steel is presented as a roll of material 50, as shown generally in FIG. 4. The strip of material 48 is stamped, or otherwise cut, to the desired shape from the roll of material 50. Typically, the strip of material 48 is an elongated rectangular shape having a length L which is framed by a pair of opposing elongated edges 52 which extend along the length L and a pair of opposing ends 54. The roll of material 50 would meet or exceed the specifications of common cold rolled steel with regular matte finish surface roughness not to exceed 65 microinches. Contoured weldments can be fabricated from this stock to reliable measurements within ±0.0005 inches from any origin. The strip of material 48 is roll formed to a desired profile, as shown generally in FIG. 4. After roll forming, the strip of material maintains the desired profile of the peripheral wall. Roll forming the strip of material 48 to the desired profile creates a pre-stress which prevents spring back. The desired profile may be circular, as shown in FIGS. 6*a* and 6*b*, undulated, as shown in FIGS. 7*a* and 7*b*, etc. Alternatively, a plurality of the strips of material 48 are pieced together at adjacent ends 54 after they are roll formed to form the desired profile of the peripheral wall 44, 46.

To secure the desired profile of the strip of material 48, the ends 54 may be secured along a seam 56 to form the peripheral wall 44, 46, as shown generally in FIGS. 6*b* and 7*b*. Securing may be in the form of a weld, such as a laser weld or electron beam weld. Additionally, a dissimilar material may be used for the weld. However, any other suitable, non-deforming, weld may also be used. It should be appreciated that the seam 56 is not limited to being a weld, but may be any other suitable method for attachment of the ends 54 to each other along the seam 56. It is preferred that the length L of the strip of material 48 is slightly less than that which is needed for the desired profile, e.g., a slight taper facilitating laser welding. This allows the material used in the weld to make up the difference in the length L.

Figure 8:
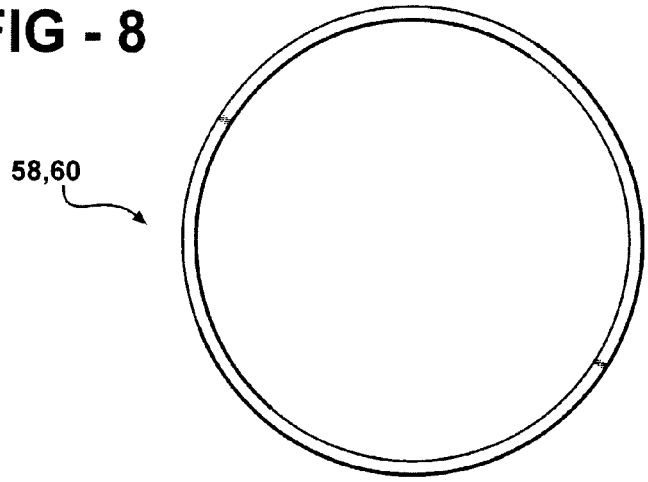
FIG. 8 is an end view of a side wall illustrating a circular perimeter.
Figure 9:
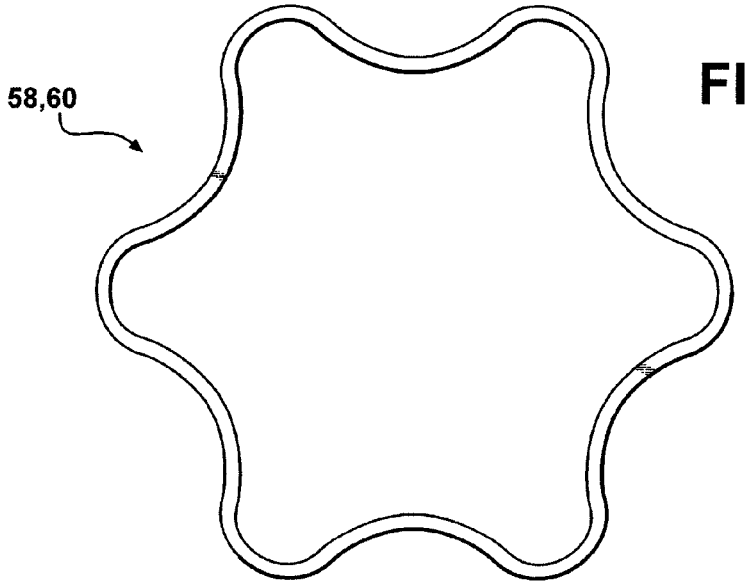
FIG. 9 is an end view of a side wall illustrating an undulating profile.
Figure 10:
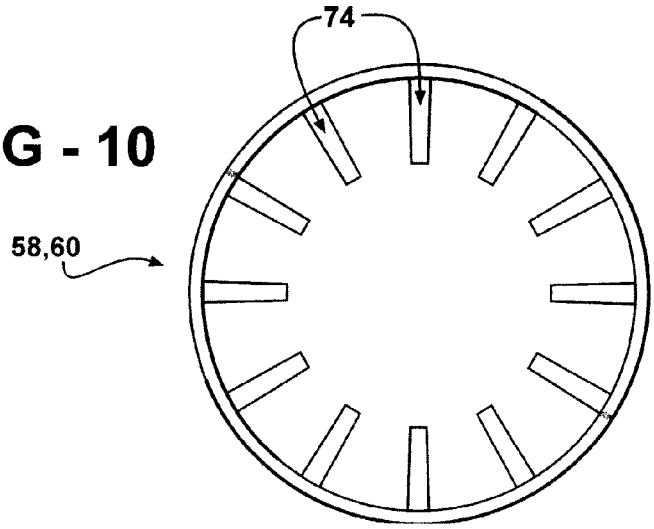
FIG. 10 is an end view of a side wall defining a plurality of grooves for receiving vane assemblies.

Referring to FIGS. 8 and 9, the inner and outer hubs 28, 30 may each include inner and outer side walls 58, 60, respectively. The respective side wall 58, 60 is disposed in perpendicular relationship to one of the edges 52 of the peripheral wall 44, 46. Typically, each side wall 58, 60 is formed from a roll of material 50. Preferably, the material is steel, but any other suitable material may also be used. The roll of material 50 would meet or exceed the specifications of common cold rolled steel with regular matte finish surface roughness not to exceed 65 microinches. Contoured weldments can be fabricated from this stock to reliable measurements within ±0.0005 inches from any origin. A portion of the roll of material 50 is roll straightened to ensure the side wall 58, 60 will be flat which will eliminate stresses on the side wall 58, 60 which the side wall 58, 60 is secured to the respective peripheral wall 44, 46. After the portion of the roll of material 50 is straightened, the side wall 58, 60 is stamped, or otherwise cut, from the roll of material 50 to form the side wall 58, 60 having a perimeter which matches the desired profile. For example, the desired profile may be circular, as shown in FIG. 8, undulated, as shown in FIG. 9, etc.

Therefore, the perimeter of the side wall 58, 60 may match the desired profile of the strip of material 48 along one of the edges 52 of the strip of material 48. The perimeter of the side wall 58, 60 and one of the edges 52 of the peripheral wall 44, 46 are typically brought together in a perpendicular relationship and secured together. The securing may be in the form of a non-deforming weld, such as a laser weld or electron beam weld. However, any other suitable weld may also be used. It should be appreciated that the bond is not limited to being a weld, but may be any other suitable method for attachment of the perimeter of the side wall to one of the edges 52 of the strip of material 48.

Figure 11C:
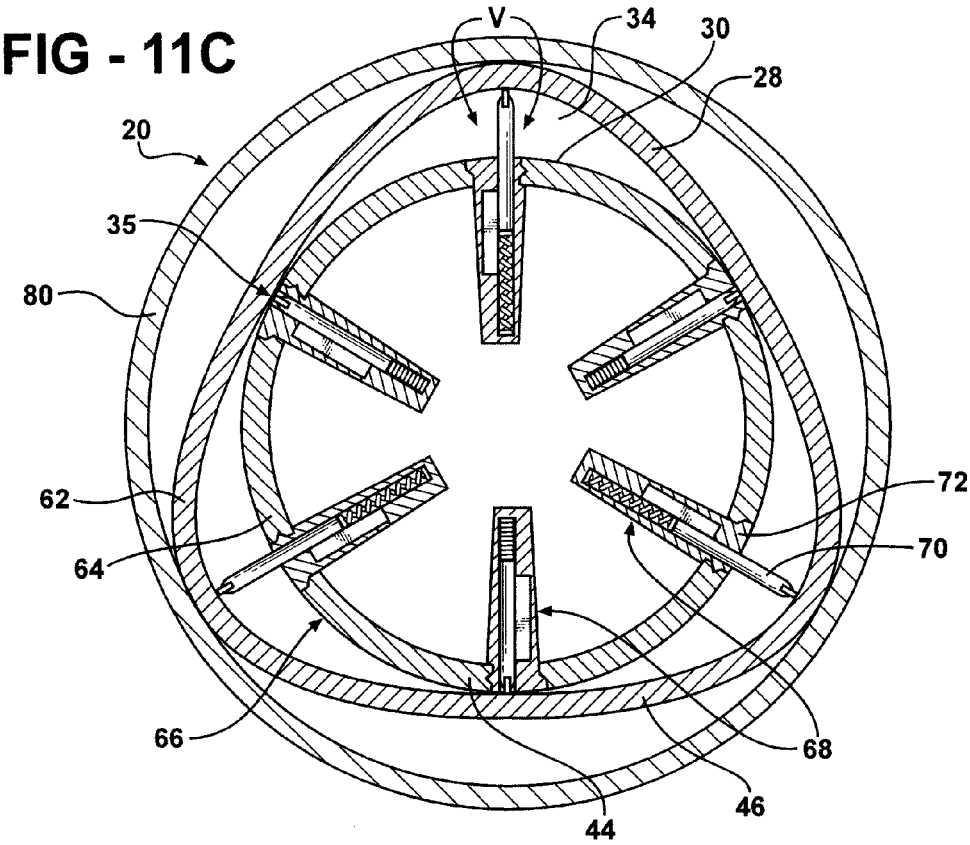
FIG. 11*c* is a cross sectional end view of the rotary device illustrating the outer hub having an alternative embodiment of the undulating peripheral wall and the inner hub having the circular peripheral wall with the vane assemblies attached to the inner hub and the circular wall surrounding the outside of the undulating peripheral wall.

In one embodiment, referring to FIGS. 11*a*-11*c*, the outer peripheral wall 46 has the undulating shape, i.e., an undulating peripheral wall 62. This means that the undulating peripheral wall 62 provides peaks 35 that are angularly spaced. The undulating peripheral wall 62 defines a generally circular opening 66 which includes an inner diameter ID as referenced from a tangent from each of the peaks 35 in the circular opening 66. The inner peripheral wall 44 has the circular shape, i.e., the circular peripheral wall 64. The circular peripheral wall 64 has a diameter D which is roughly equal to the inner diameter ID of the undulating peripheral wall 62. When the rotary device 20 is assembled, the circular peripheral wall 64 is placed within circular opening 66 of the undulating peripheral wall 62. More specifically, the circular peripheral wall 64 fits within the inner diameter ID defined by the peaks 35 of the undulating peripheral wall 62. Therefore, the peaks 35 generally remain in constant rotational contact with the opposing circular peripheral wall 64. However, it should be appreciated that the inner diameter ID of the undulating peripheral wall 62 may be sized such that the inner diameter ID of the undulating peripheral wall 62 is slightly larger than the diameter D of the circular peripheral wall 64 to prevent the peripheral walls 44, 46 from contacting one another which may result in undesired wear between the walls 44, 46. An additional benefit is achieved when the peripheral walls 44, 46 do not contact one another is that lubrication may not be required.

Figure 12:
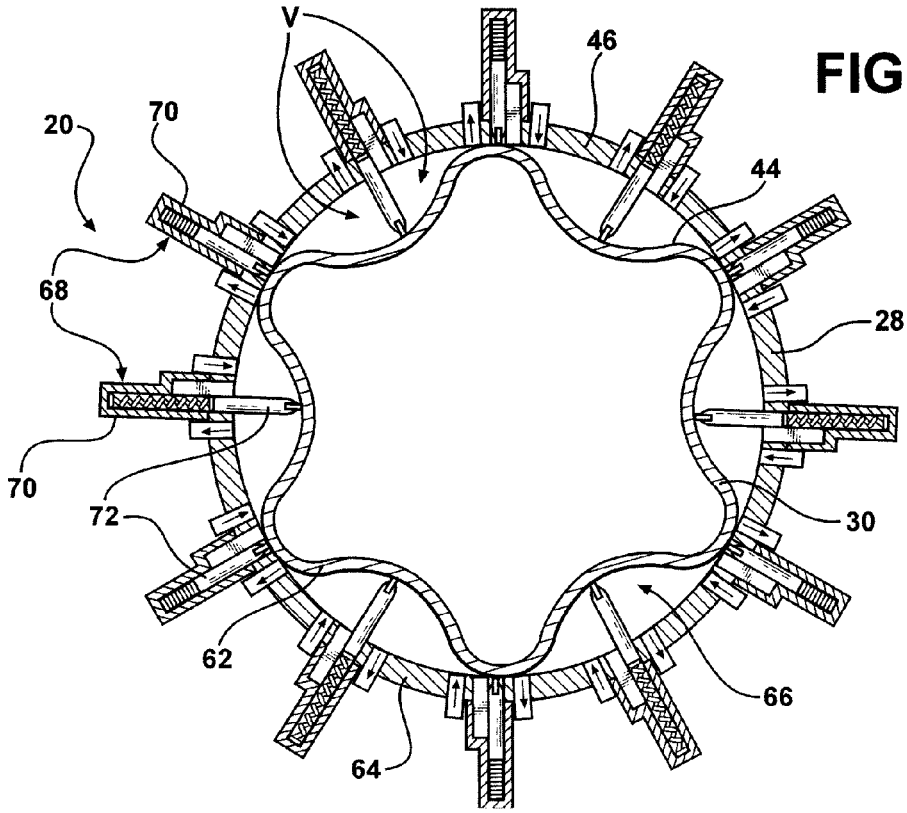
FIG. 12 is a cross sectional end view of the rotary device illustrating the outer hub having the circular peripheral wall and the inner hub having the undulating peripheral wall with the vane assemblies attached to the outer hub.

Alternatively, referring to FIG. 12, the inner peripheral wall 44 has the undulating circular shape, i.e., the undulating peripheral wall 62. This means that the inner peripheral wall 44 provides peaks 35 that are angularly spaced. The undulating peripheral wall 62 defines a generally circular exterior which has an outer diameter OD as referenced from a tangent from each of the peaks 35 on the exterior. The outer peripheral wall 46 has the circular shape, i.e., the circular peripheral wall 64. The circular peripheral wall 64 defines an opening 66 which has a diameter D roughly equal to the outer diameter OD of the undulating peripheral wall 62. When the rotary device 20 is assembled, the circular peripheral wall 64 is placed about the exterior of the undulating peripheral wall 62. More specifically, the peaks 35 of the undulating peripheral wall 62 fit within the opening of the circular peripheral wall 64. Therefore, the peaks 35 generally remain in constant rotational contact with the opposing circular peripheral wall 64. However, it should be appreciated that the outer diameter OD of the undulating peripheral wall 62 may be sized such that it is slightly smaller than the diameter D of the circular peripheral wall 64 to prevent the peripheral walls 44, 46 from contacting which may result in undesired wear. Additionally, lubrication may not be required when the walls do not contact one another.

Because the peaks 35 and the circular peripheral wall 64 remain in a constant sealing relationship, a working chamber 34 is defined between each pair of adjacent peaks 35 and the circular peripheral wall 64. Therefore, the peripheral walls 44, 46 and the side walls which are secured to the outer peripheral wall 46 define the working chambers 34. The quantity of working chambers 34 is any number, based on the number of peaks 35 on the undulating peripheral wall 62. This means that the number of peaks 35 equals the number of working chambers 34.

A plurality of vane assemblies 68 are spaced a predetermined angle relative to one another about the axis 22. Each vane assembly 68 includes a housing 72 and a vane 72 which moves radially into and out of the housing 70. Each vane assembly 68 is supported for radial movement by the inner or outer hub 28.

The circular peripheral wall 64 supports the vane assemblies 68 such that the vanes 72 move radially to maintain sealing contact with the undulating peripheral wall 62 as the rotor rotates relative to the stator 24. The vanes 72 also seal against the outer side wall 60 which are connected to the edges 52 of the outer peripheral wall 46. Therefore, as the rotor rotates with respect to the stator 24, the vanes 72 move into and out of the housing 70 as they follow the undulating peripheral wall 62 as they also seals against the outer side walls.

The vanes 72 are angularly spaced to coincide with each working chamber 34 such that there one or more vanes 72 coinciding with each working chamber 34 at all times during rotation of the rotor 26. However, there may be more than two vanes 72 coinciding with each working chamber 34. The vanes 72 sequentially and periodically divide each working chamber 34 into a leading side and a trailing side of each vane 72, relative to the direction of rotation of the rotor 26. The leading side of the vane 72 faces the direction of the rotor rotation. The trailing side of the vane 72 faces opposite the direction the rotor rotates. Within the working chamber 34, each peak 35 and the next adjacent vane 72 cooperate to define a working volume V. The working volume V may be the volume between the leading side of the vane 72 and the peak 35 or the volume between the trailing side of the vane 72 and the peak 35. In either case, the working volume V varies (i.e., increases or decreases) as the rotor rotates. This is because as the vane 34 travels along the undulating peripheral wall 62, the vane 34 is either moving toward or away from the next adjacent peak 35. As the vane 34 moves toward the peak 35 the working volume V decreases and a fluid disposed in that working volume V, defined between the leading side of the vane 34 and the peak 35 is reduced and any fluid in the working volume V is compressed. Likewise, as the vane moves away from the peak 35, the working volume V increases and the fluid disposed in that working volume V, defined between the trailing side of the vane 34 and the peak 35 is increased and any fluid in the working volume V is expanded. Accordingly, the vane assemblies 68 may be supported by the inner or outer peripheral wall 44, 46. The only requirement is that the inner or outer peripheral wall 44, 46 supporting the vane assembles is the circular peripheral wall 64 such that the vanes 72 are able to maintain the sealing relationship with the undulating peripheral wall 62.

Figure 13:
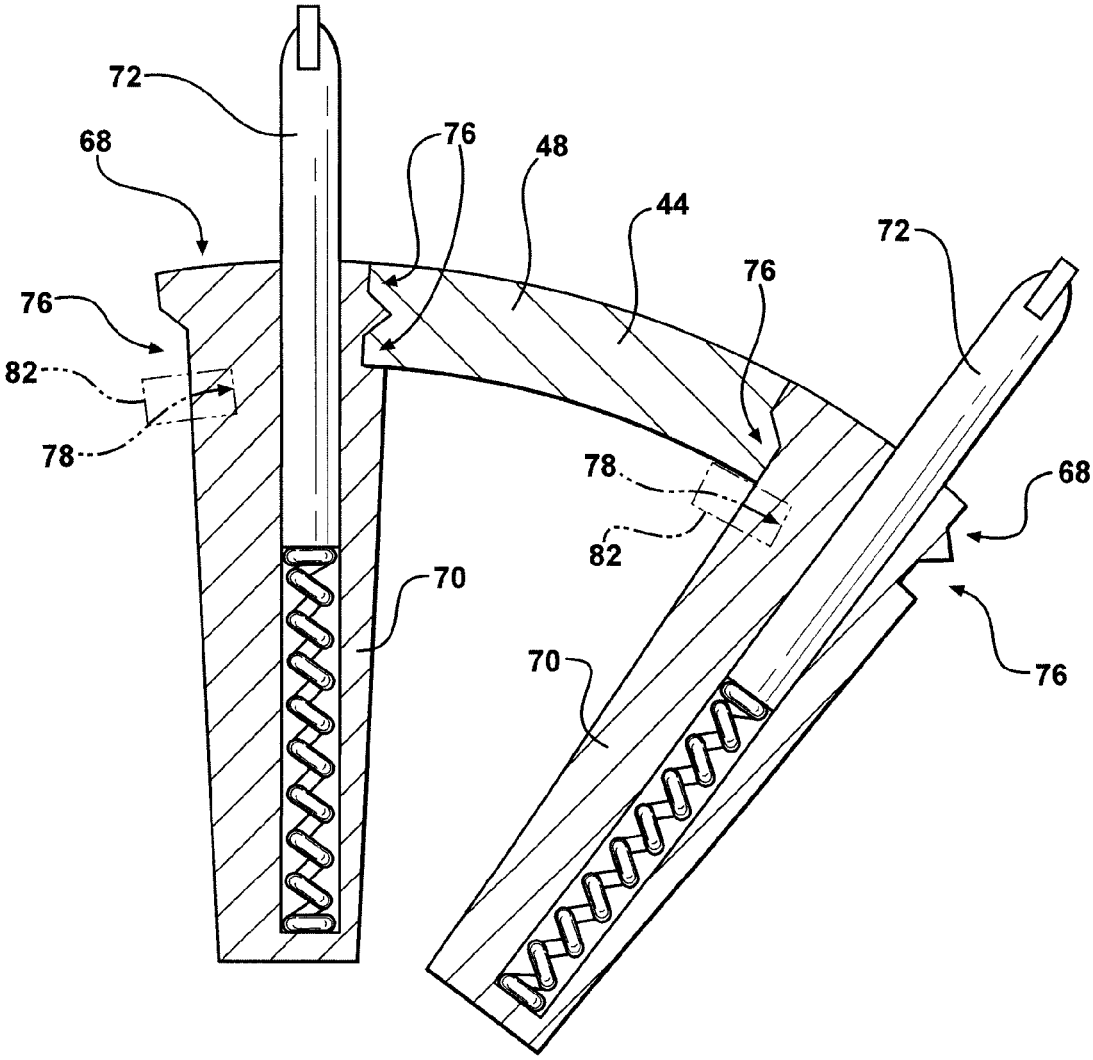
FIG. 13 is a sectional end view of a pair of vane assemblies defining grooves and a strip of material inserted within the grooves for forming the peripheral wall.

A. Assembly and Operation of the Undulating Outer Peripheral Wall with the Circular Inner Peripheral Wall Referring again to FIGS. 11*a*-11*c*, when the circular peripheral wall 64 is formed on the inner hub 30, the vane assemblies 68 are also assembled to the inner hub 30. To assemble the rotary device 20 with this configuration, the side wall which corresponds to the inner circular peripheral wall 64, i.e., inner side wall 58 is laid on its side. Preferably, grooves 74, which are angularly spaced about the side wall 58, are defined in the side wall 58. Each groove 74 corresponds to a portion of the vane assembly 68, e.g., the housing 70. The vane assemblies 68 are fitted into and retained by the grooves 74. It should be appreciated that the invention is not limited to defining grooves 74 on the side wall 58, as any acceptable manner of attaching the vane assemblies 68 to the inner hub 30 may also be used. In one embodiment, the outer undulating peripheral wall 62 is also laid on its edge 52 and centered about the inner side wall 58 before the vanes 72 are assembled to the inner side wall 58. In an alternative embodiment, the outer undulating peripheral wall 62 is fitter over the inner side wall 58 and the vanes 72 after the vanes 72 are assembled to the inner side wall 58. The housing 70 for each vane assembly 68 also defines a pair of opposing notches 76 which extend perpendicular to the side walls when the vane assemblies 68 are assembled to the side wall 44, as shown in FIG. 13. Once the vane assemblies 68 are assembled to the inner side wall 58, individual pieces of the roll formed strip of material 48 are snapped into adjacent notches 76 on the housings 70 to form the inner peripheral wall 44. Again, the roll formed strips of material 48 may be snapped into place after the outer peripheral wall 46 has been centered about the inner side wall 58 and the vane assemblies 68 have already been assembled to the inner side wall 58. Additionally, an indentation 78 may be defined in one or both sides of the vanes 72 for receiving a block 82 which is wedged beneath the strip of material 48, after the strip of material 48 is snapped into place. Alternatively, the roll formed strips of material 48 may be snapped into the notches 76 first and then the vane assemblies 68 and the strips of material 48 are inserted as a single assembly into the opening 66 of the inner peripheral wall 44. A second inner side wall 58 may be attached opposite the first inner side wall 58. However, this is not required.

In this configuration, it is preferred that the outer hub 28 rotate with respect to the inner hub 30, which houses the vane assemblies 68. This helps to eliminate balancing issues which may be associated with rotating the vanes 72. In this configuration, the inner hub 30 is held stationary and the power is taken from the rotation of the outer hub 28. For example power is taken via pulleys, belts, gears, etc.

Alternatively, the inner hub 30 rotates wither respect to the outer hub 28. This means that the vanes 72 rotate with respect to the outer hub 28. Preferably, a bearing is inserted through the inner side wall(s) 58 along the axis 22. The outer hub 28 is held stationary. In this configuration, the power is taken from the rotation of the inner hub 30. For example, power is taken via pulleys, belts, gears, drive shafts, etc. Additionally, any required piping for fluid or fuel may be sent through the bearing to reach the working chambers 34.

B. Assembly and Operation of the Undulating Inner Peripheral Wall 44 with the Circular Outer Peripheral Wall 46

Referring again to FIG. 12, in an alternative embodiment, when the circular peripheral wall 64 is formed on the outer hub 28, the vane assemblies 68 are also assembled to the outer hub 28. To assemble the rotary device 20 with this configuration, one of the outer side walls 60 is secured to one of the edges 52 of the outer peripheral wall 46. Holes are formed through the outer peripheral wall 46 where each hole corresponds to a location for one of the vane assemblies 68. Preferably, the holes are formed during the roll forming and/or cutting process. A vane assembly 68 may be fitted through each hole and attached to the outer peripheral wall 46. It should be appreciated that the invention is not limited to attaching the vane assemblies 68 to the outer peripheral wall 46 in this manner, but may be attached to the outer hub 28 in any acceptable manner. The inner hub 30 includes the inner peripheral wall 44 which may be attached to one or two inner side walls 58. The inner side walls 58 may be used to provide structural support for the inner peripheral wall 44 or as a place for mounting the bearing. However, the inner side walls 58 are not required to do this as any other suitable configuration may also be used for the inner hub 30, e.g., spokes, etc. The inner undulating peripheral wall 62 is inserted inside the opening 60 the outer circular peripheral wall 64. The outer side walls 60 are each secured to an edge 52 of the outer circular peripheral wall 64. Preferably, the outer side walls 60 also retain the inner hub 30 within the outer hub 28.

In this configuration, it is preferred that the inner hub 30 rotate with respect to the outer hub 28, which houses the vanes 72. This helps to eliminate balancing issues associated with rotating the vanes 72. In this configuration, the outer hub 28 is held stationary and the power is taken from the rotation of the inner hub 30. For example power is taken via pulleys, belts, gears, etc. Preferably, a bearing is inserted through the inner side wall(s) 58 along the axis 22. However, if another type of configuration, e.g., spokes, etc., is used, the bearing is centered along the axis 22 on that configuration. Additionally, any required piping for fluid or fuel may be sent through the bearing to reach the working chambers 34.

Alternatively, the outer hub 28 rotates with respect to the inner hub 30. This means that the vanes 72 rotate with respect to the inner hub 30. The inner hub 30 is held stationary as the outer hub 28 rotates. In this configuration, the power is taken off of the rotation of the inner hub 30. For example, power is taken via pulleys, belts, gears, etc.

Regardless of the configuration, after the inner vane assemblies 68 are assembled and installed, the outer side walls 60 are secured to the outer peripheral wall 46 of the outer hub 28. Once both of the outer side walls 60 are secured to the outer peripheral wall 46, each working chamber is considered to be sealed. As referenced above, sealing is determined by the amount of tolerance designed into the individual components. The tighter the tolerance of the components, the better the seal. In some instances, a little bit of leakage from the working chamber 34 is desired. In other instances, no leakage is desired. The flexibility of the manufacture of the configurations of the inner and outer hubs 28, 30 allows for the amount of leakage to be designed into the final assembly of the rotary device 20.

Additionally, to reduce weight of the overall assembly of the rotary device 20, holes may be formed within one or more of the side walls 58, 60 where it is not critical to sealing the working chambers, the structural integrity, or rotational balance of the rotary device 20. Therefore, the number and location of the holes is a matter of preference. Additionally, other holes may be formed in the side walls or peripheral walls 44, 46 for receiving vales, spark plugs, nozzles, electronics etc. which may be associated with the function of the rotary device 20.

To add structural stability and/or to provide a surface for power take off from the rotary device 20 when the outer hub 30 includes the undulating peripheral wall 62, a circular wall 80 may be roll formed from a strip of material 48 and attached to the exterior of the undulating peripheral wall 62, as shown generally in FIGS. 1, 11*b*, and 11*c*. Additionally, the perimeter of the outer side wall 60 may be sized to match the profile of the circular wall 80 as opposed to the profile of the undulating peripheral wall 62. In this case, the outer side wall 60 may be secured to the circular wall 80 and/or the undulating peripheral wall 62.

As noted above, the process for attaching the perimeter of the side wall 58, 60 to the associated peripheral wall 44, 46 may use electron beam and laser welding to provide zero deformation and therefore precision sealing between all of the components in the rotary device 20 during rotation of the rotor 26. When the bearing is installed in the side walls 58, 60 of the inner hub 30, using precise cold insertion or equivalent low deformation insertion of the bearing before cutting the perimeter of the side wall(s) 58, 60 assures concentricity and balance between the inner and outer hubs 28, 30. Final grinding or polishing of the perimeter of the side wall(s) 58, 60 and/or the seam(s) 56 of the peripheral wall(s) 44, 46 assures close tolerances before mating of the inner hub 30 to the outer hub 28.

To reduce erosion, deformation, and corrosion in "hot zones" of the walls 44, 46, 58, 60, the selective use of ceramics, especially as inserts, may be employed. Additionally, the hot zones of the walls 44, 46, 58, 60 may be sprayed and protected from wear by designing a separate wall on which to run the vanes 72. For example, ceramics are inserted and attached to one or more of the desired walls 44, 46, 58, 60. Use of surface hardening by selective methods, e.g., laser, focuses on specific areas, such as impact zones, rather than the more costly treatment of entire parts or use of more costly materials.

The walls 44, 46, 58, 60 are manufactured from cold mill surface finishing and hardening. Contoured components of corresponding shape and finish precision may be formed as ceramics, extruded metal such as aluminum, injected with amorphous metals, or cut by wire and other Electronic Discharge Machining (EDM) processes.

The rotary device 20 also allows for "scalability". Accordingly, the components of the rotary devices 20 can be manufactured to meet the output performance requirements of the rotary device 20. For example, the volume of the working chamber can be manufactured to meet the output performance requirements of the rotary device 20 based a diameter of the rotor 26, a width of the rotor 26, and a height of the working chamber 34. Additionally, a plurality of rotors may be ganged along the axis 22, or radially stacked, and the total number or rotors (and stators 24) may be varied at the time of manufacturing to meet the output performance requirements of the rotary device 20. Therefore, the size ranges from the largest of aircraft engines, locomotives, and stationary power applications down to golf-ball sized miniature versions and even sub-miniaturized applications may be achieved with great manufacturing flexibility at a single location.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A method of constructing a rotary device having an outer hub and an inner hub disposed within the outer hub where one of the inner and outer hub is rotatable with respect to the other one of the inner and outer hub about an axis, said method comprising the steps of:

roll forming a first ribbon of material which extends between opposite ends to achieve a desired profile of an outer peripheral wall;

securing the roll formed first ribbon of material to maintain the desired profile and achieve the outer peripheral wall;

roll forming a second ribbon of material which extends between opposite ends to achieve a desired profile of an inner peripheral wall;

securing the roll formed second ribbon of material to maintain the desired profile and achieve the inner peripheral wall; and inserting the inner peripheral wall inside the outer peripheral wall such that the outer peripheral wall surrounds the inner peripheral wall;

further comprising the step of abutting ends of one of the first and second ribbons of material and said steps of securing are further defined as securing at least one of the ribbons of material where the ends of the one of the first and second ribbons of material abut.

2. A method of constructing a rotary device as set forth in claim 1 further comprising the steps of polishing the ribbons of material to a specified surface variation not exceeding 95 microinches.

3. A method of constructing a rotary device as set forth in claim 1 wherein said steps of securing are further defined as welding.

4. A method of constructing a rotary device as set forth in claim 3 wherein said step of welding is further defined as laser welding.

5. A method of constructing a rotary device as set forth in claim 3 wherein said step of welding is further defined as electron beam welding.

6. A method of constructing a rotary device having an outer hub and an inner hub disposed within the outer hub where one of the inner and outer hub is rotatable with respect to the other one of the inner and outer hub about an axis, said method comprising the steps of:

roll forming a first ribbon of material which extends between opposite ends to achieve a desired profile of an outer peripheral wall;

securing the roll formed first ribbon of material to maintain the desired profile and achieve the outer peripheral wall;

roll forming a second ribbon of material which extends between opposite ends to achieve a desired profile of an inner peripheral wall;

securing the roll formed second ribbon of material to maintain the desired profile and achieve the inner peripheral wall; and inserting the inner peripheral wall inside the outer peripheral wall such that the outer peripheral wall surrounds the inner peripheral wall;

further comprising the steps of:

providing at least one opening in one of the peripheral walls; and inserting a vane assembly through each opening such that the vane extends to the other one of the peripheral walls in a sealing relationship.

7. A method of constructing a rotary device as set forth in claim 6 further comprising the step of securing the vane assembly to the one of the peripheral walls.

8. A method of constructing a rotary device as set forth in claim 6 further comprising the steps of securing an outer side wall to en edge of the outer peripheral wall and securing the vane assembly to the outer side wall.

9. A method of constructing a rotary device having an outer hub and an inner hub disposed within the outer hub where one of the inner and outer hub is rotatable with respect to the other one of the inner and outer hub about an axis, said method comprising the steps of:

roll forming a first ribbon of material which extends between opposite ends to achieve a desired profile of an outer peripheral wall;

securing the roll formed first ribbon of material to maintain the desired profile and achieve the outer peripheral wall;

roll forming a second ribbon of material which extends between opposite ends to achieve a desired profile of an inner peripheral wall;

securing the roll formed second ribbon of material to maintain the desired profile and achieve the inner peripheral wall; and inserting the inner peripheral wall inside the outer peripheral wall such that the outer peripheral wall surrounds the inner peripheral wall;

further comprising the steps of providing a side wall, and securing the side wall to an edge of one of the inner and outer peripheral wall.

10. A method of constructing a rotary device as set forth in claim 9 further comprising the step of forming the side wall to have a perimeter which matches the desired profile of one of the inner and outer peripheral wall.

11. A method of constructing a rotary device as set forth in claim 10 wherein said step of forming is further defined as stamping.

12. A method of constructing a rotary device as set forth in claim 10 further comprising the step straightening the side wall.

13. A method of constructing a rotary device as set forth in claim 12 wherein said step of straightening is further defined as roll straightening.

14. A method of constructing a rotary device as set forth in claim 9 wherein said step of securing the side wall is further defined as welding.

15. A method of constructing a rotary device as set forth in claim 9 wherein the side wall is further defined as an outer side wall and the one of the inner and outer peripheral walls is further defined as the outer peripheral wall.

16. A method of constructing a rotary device as set forth in claim 9 wherein the side wall is further defined as an inner side wall and the one of the inner and outer peripheral walls is further defined as the inner peripheral wall.

17. A method of constructing a rotary device as set forth in claim 9 further comprising the step of polishing the side wall to a specified surface variation not exceeding 95 microinches.

18. A method of constructing a rotary device as set forth in claim 17 wherein the steps of polishing the ribbons of material is further defined as polishing the ribbon of material to a specified surface variation not exceeding 95 microinches.

19. A method of constructing a rotary device as set forth in claim 9 further comprising the step of securing a second side wall to a second edge of one of the inner and outer peripheral wall.

* * * * *

UNITED STATES PATENT AND TRADEMARK OFFICE

CERTIFICATE OF CORRECTION

PATENT NO. : 7,621,167 B2
APPLICATION NO. : 11/532376
DATED : November 24, 2009
INVENTOR(S) : Gilbert Staffend It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 517 days.

Signed and Sealed this

Twenty-sixth Day of October, 2010

David J. Kappos

David J. Kappos
*Director of the United States Patent and Trademark Office*